US006885729B2

(12) United States Patent
Klausz

(10) Patent No.: US 6,885,729 B2
(45) Date of Patent: Apr. 26, 2005

(54) ANTISCATTER GRID AND METHOD OF FABRICATING SUCH A GRID

(75) Inventor: Rémy Klausz, Neuilly/Seine (FR)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 113 days.

(21) Appl. No.: 10/328,210

(22) Filed: Dec. 23, 2002

(65) Prior Publication Data

US 2003/0123615 A1 Jul. 3, 2003

(30) Foreign Application Priority Data

Dec. 31, 2001 (FR) ..... 01 17095

(51) Int. Cl.[7] ..... G21K 1/00
(52) U.S. Cl. ..... 378/154
(58) Field of Search ..... 378/154, 155

(56) References Cited

U.S. PATENT DOCUMENTS 2,178,798 A 11/1939 Lindstedt et al. ..... 250/63
4,951,305 A 8/1990 Moore et al. ..... 378/147
5,357,553 A * 10/1994 Ferlic et al. ..... 378/154
6,438,210 B1 * 8/2002 Castleberry ..... 378/154

FOREIGN PATENT DOCUMENTS

GB 593352 10/1947

* cited by examiner

*Primary Examiner*—Craig E. Church
*Assistant Examiner*—Jurie Yun
(74) *Attorney, Agent, or Firm*—Cantor Colburn LLP

(57) ABSTRACT

A method of fabricating an antiscatter grid, an antiscatter grid element and the antiscatter grid formed by the method comprising: forming grid elements by covering portions of at least one substrate with strips made of a radiation absorbent material wherein the portions of the substrate are dimensioned with a width greater than the width of the strips made of the absorbent material. The grid elements are superimposed. Pressing or grasping the superimposed grid elements at least on the parts of the element not covered with the absorbent material. The elements can be formed on a single substrate or on strips of substrate each one supporting a strip made of the absorbent material.

25 Claims, 4 Drawing Sheets

ANTISCATTER GRID AND METHOD OF FABRICATING SUCH A GRID

CROSS-REFERENCE TO RELATED APPLICATIONS

This application claims the benefit of a priority under 35 USC 119 to French Patent Application No. 01 17095 filed Dec. 31, 2001, the entire contents of which are hereby incorporated by reference.

BACKGROUND OF THE INVENTION

The invention relates to antiscatter grids used in radiological imaging.

A radiological imaging apparatus conventionally comprises a source of X-rays and an image receiver, between which the object of which it is desired to produce an image is positioned. The beam emitted by the source passes through the object before reaching the receiver. It is partly absorbed by the internal structure of the object such that the intensity of the beam received by the receiver is attenuated. The overall attenuation of the beam having passed through the object is directly linked to the distribution of absorption in the object.

The image receiver comprises an optoelectronic detector or a strengthening film/screen pair sensitive to the radiation intensity. Consequently, the image generated by the receiver corresponds in principle to the distribution of the overall attenuations of the rays due to the latter passing through the internal structures of the object.

Part of the radiation emitted by the source is absorbed by the internal structure of the object, the other part is either transmitted (primary or direct radiation), or scattered (secondary or diffused radiation). The presence of diffused radiation leads to degradation in the contrast of the image obtained and to a reduction in the signal/noise ratio. This is particularly problematic, in particular when it is desired to view details of the object.

One solution to this problem comprises inserting an "antiscatter" grid between the object to be X-rayed and the image receiver. These grids are usually formed from a series of parallel plates made of an X-ray-absorbent material. In the grids, called "focused" grids (according to the terminology defined by the IEC 60627 standard relating to "Diagnostic X-ray imaging equipment—Characteristics of general purpose and mammographic antiscatter grids"), all the planes of the plates intersect along the same straight line passing through the focal point of the radiation emitted by the source. Thus, these grids make it possible for the direct radiation to pass through and for the scattered radiation to be absorbed. These antiscatter grids have made it possible for the contrast of the images obtained to be considerably improved.

The conventional antiscatter grids comprise a series of oriented parallel plates comprising a material which strongly absorbs X-rays, such as lead, for example, held between strip inserts which are made of a material more transparent to X-rays than the plates, such as aluminum or cellulose fibers (paper or wood).

A conventional method of fabricating antiscatter grids comprises alternately stacking plates of absorbent material and strip inserts made of a material transparent to X-rays. In order to obtain a focused grid, the plates must be accurately positioned at a slight angle with respect to the previous plate, such that all the planes of the plates converge along a straight line passing through the source.

The disadvantage of a fabricating process of this sort is that it tends to create cumulative errors in the angular position of the plates. These errors are detrimental to the performance of the grid.

BRIEF DESCRIPTION OF THE INVENTION

An embodiment of the invention provides a method of fabricating an antiscatter grid and the antiscatter grid formed by the method comprising: forming grid elements by covering portions of at least one substrate with strips made of a radiation absorbent material wherein the portions of the substrate are dimensioned with a width greater than the width of the strips made of the absorbent material; superimposing on each other the grid elements thus obtained; and pressing or grasping the superimposed grid elements at least on the parts of the element not covered with the absorbent material. The elements can be formed on a single substrate or on strips of substrate each one supporting a strip made of the absorbent material.

BRIEF DESCRIPTION OF THE DRAWINGS

The invention and embodiments thereof will be better understood from the following description when read with respect to the appended drawings, in which.

DETAILED DESCRIPTION OF THE INVENTION

In the remainder of the description, the expression "grid element" denotes an assembly of a layer of absorbent material and a layer of material that is more transparent to radiation, such as X-rays. A method of fabricating antiscatter grids comprises successively stacking "grid elements", these elements being positioned substantially transversely.

Figure 1:
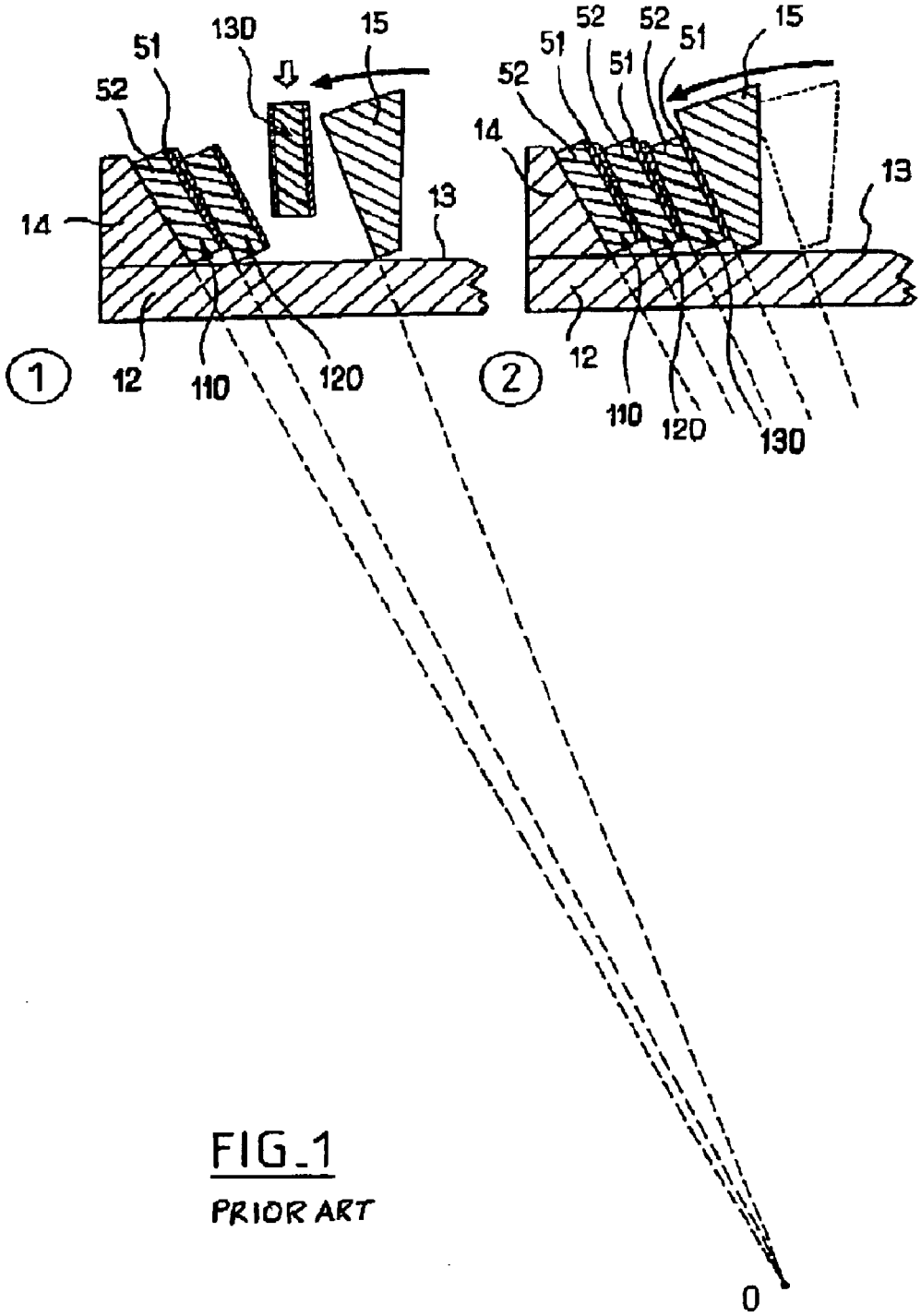
FIG 1 PRIOR ART
FIG. 1 is a diagram showing an example of the method of fabricating a focused grid of the prior art.

In FIG. 1, the fabricating method illustrated uses a slab 12 having a flat reference surface 13 and a wedge 14 positioned on the slab 12. A first grid element 110 formed by assembling a layer 51 of radiation absorbent material forming a plate and a layer 52 of material transparent to the radiation forming a strip insert is positioned in abutment on the surfaces defined by the wedge 14 and the slab 12. Another element 120 has already been positioned after this first element 110.

A positioning or grasping tool 15 mounted on a swing arm positions the following element 130 until it comes into contact with the previously positioned element 120. The following element 130 is thus wedged on the preceding element 120 and on the surface of the slab 13 on which all the elements 110, 120 rest.

The element 130 is pressed against the positioning tool 15 such that one of its faces is in contact with the flat surface of the tool 15. Since the tool 15 is mounted on a swing arm which is able to pivot about a fixed point O, the positioning surface is always in a plane containing the point O. Consequently, the elements 110, 120, 130 are assembled successively such that the layers of absorbent material 51 are substantially in the planes containing the point O.

Each element, once positioned in contact with the preceding element using the grasping tool, is adhesively bonded thereto in position. A grid comprising a series of absorbent 51 and transparent 52 layers is thus obtained; the absorbent layers 51 being focused on the point O.

In the method of FIG. 1, the grid accuracy obtained depends on the angle of the absorbent plates 51 and on the accuracy of the flat surface 13 of the slab 12. In the method of FIG. 1, while they are being positioned, the elements can only be guided over a very small width (typically a width of 1.5 mm to 3 mm).

Figure 2:
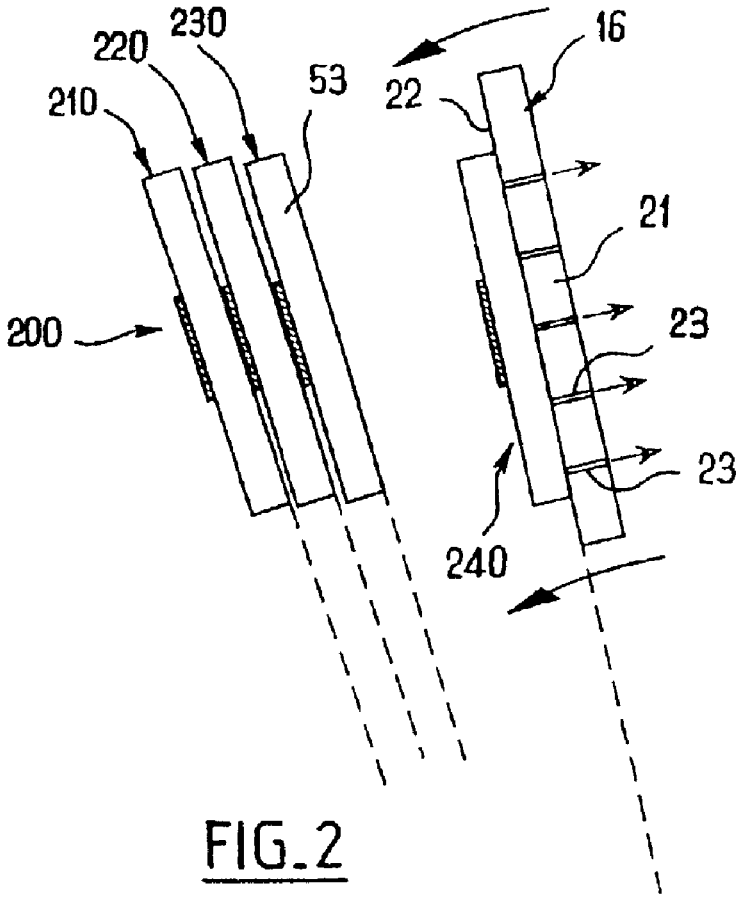
FIG. 2 is a diagram representing an example of the method of fabricating a focused grid according to one embodiment of the invention in which the elements to be stacked are obtained by cutting.

FIG. 2 illustrates a method of fabricating a focused grid according to one embodiment of the invention. According to this embodiment, the grid elements 210, 220, 230 comprise a plate 51 made of a material absorbing radiation, such as X-rays, and a substrate plate 53 made of a more radiation transparent material, this latter plate 53 having a width that is greater than the absorbent plate 51. For example, the width of the absorbent plate 51 is about 2 mm and the width of the transparent plate 53 is about 20 mm.

The elements are handled using a positioning or grasping tool 16 mounted on a swing arm or a circular slideway guide system. A positioning or grasping tool of this sort may, for example, comprise a vacuum plate holder similar to those generally used in photography. This type of plate holder comprises a platen 21 defining a flat surface 22 in contact with the element 240 to be positioned and conduits 23 passing through the platen 21 between the surface 22 in contact with the element 240 and the opposite surface of the platen 21. Each conduit 23 is connected to suction means (not shown). The suction means suck out the air contained between the element 240 and the surface 22 of the platen 21 with which it is in contact via the conduits 23. Thus, the element 240 to be positioned is pressed against the surface 22 of the plate holder by vacuum.

In a positioning or grasping tool of this sort, the distance between the conduits 23 is negligible compared to the radius of curvature of the element 240 to be positioned such that the element is held perfectly flat.

Figure 3:
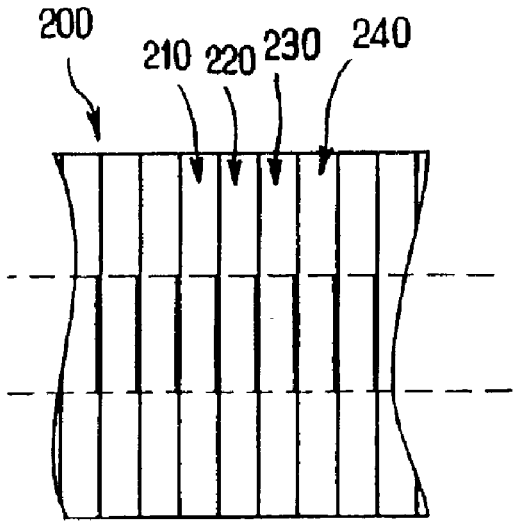
FIG. 3 is a diagram representing a stack obtained by the method shown in FIG. 2.

Adhesive is spread on the element 240 and then it is stacked on the previous element 230 using the positioning or grasping tool 16 mounted on the swing arm or the circular slideway guide system. The elements 210, 220, 230, 240 are thus assembled successively. About 30 to 70 elements are stacked per cm. The stack 200 thus formed is then cut transversely to the layers of elements so that the width of the absorbent plates and of the strip inserts are made equal and a flat grid having a thickness of about 1 to 3 mm is obtained. As shown in FIG. 3, the stack 200 is cut along the dotted lines.

Preferably, the final cutting will be carried out at a distance from the plates corresponding at least to the range of influence of the cutting tool and not flush with the absorbent plates. This arrangement makes it possible not to impair the flatness of the edges of the absorbent plates, which will prevent artifacts being generated when the grid is used.

In a variant of the method of fabricating an antiscatter grid, the elements are formed over a continuous strip of flexible substrate supporting aligned absorbent strips, the absorbent strips being aligned along their longitudinal axis, or along their transverse axis. The continuous strip of substrate is coiled and the positioning device comprises a magazine in which the coil of substrate is stored. Rigid guides or rollers make it possible for the coil of substrate to be uncoiled and for the elements to be continuously positioned.

As in the above method, the positioning device comprises a positioning or grasping tool mounted on a swing arm or on a circular slideway guide system. The elements are positioned by the guides or the rollers, held in position by the positioning or grasping tool, fixed with respect to the previous element, then cut and separated from the coil of substrate.

In this variant of the method, the accurate positioning of the substrate is ensured either by the direct guiding of the strips of substrate, or by guiding a vacuum plate holder, as described above, supporting the element to be positioned.

Where the absorbent strips are aligned along their transverse axis, they are positioned transversely to the direction in which the coil of substrate is uncoiled, the magazine can advantageously be mounted with the positioning tool on the swing arm or the circular slideway guide system.

The fabrication of grid elements 210, 220, 230, 240 will now be described.

Figure 4:
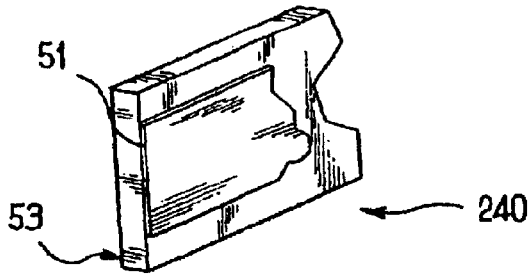
FIG. 4 is a diagram representing an element used to produce a stack according to an embodiment of the method of the invention.

As shown in FIG. 4, the grid elements 240 comprise a layer 51 made of a material absorbing radiation, such as X-rays, pressed against a substrate 53 in the form of a wider strip of material absorbing fewer X-rays. The absorbent layer 51 is generally made of a metal such as gold, copper, tantalum or lead, it being possible for these materials to be used alone, in combination or in association with other materials.

Preferably, the absorbent strips are made of copper or of gold or of copper coated with gold or of copper coated with lead. In particular, where the absorbent strips are made of copper coated with lead, the total thickness of a strip of metal is preferably less than 50 $\mu$m and the thickness of lead is between 5 and 30 $\mu$m.

Figure 5:
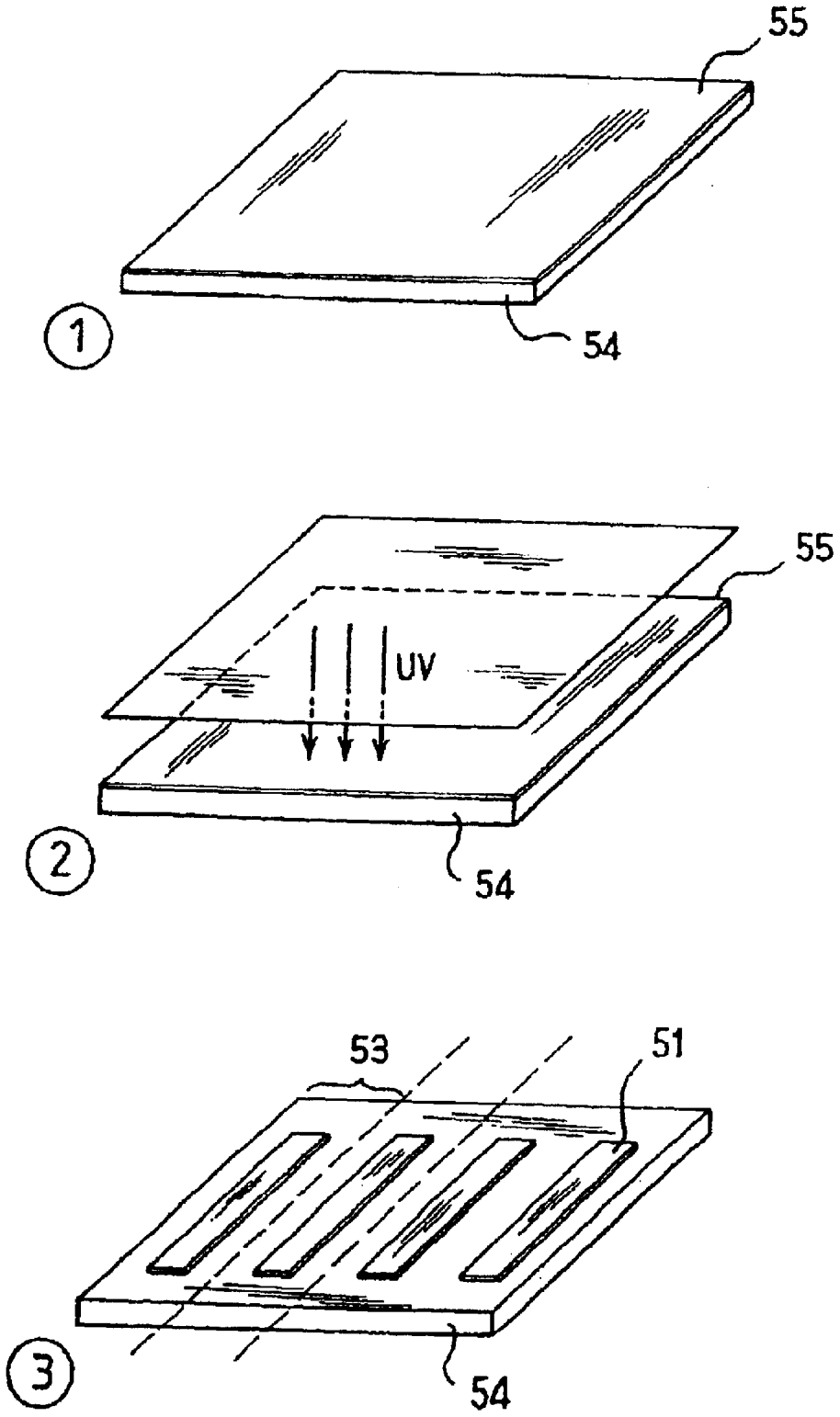
FIG. 5 is a diagram representing the different steps for obtaining elements used in an embodiment of the method of the invention.

FIG. 5 shows an embodiment of a method for obtaining such elements. In order to obtain the elements, it is possible to use, for example, metal-deposition techniques commonly used in the fabrication of printed circuits. These techniques generally consist in depositing a layer of metal 55 on a substrate 54 made of a polymer, by lamination (step 1). The substrate 54 may, for example, be made of an epoxy resin or a polyimide (the polyimide makes it possible to form a flexible substrate). The metal 55 is treated chemically in order to obtain good metal/substrate adhesion. The metal layer 55 is then covered with a photosensitive film generally called a "resist". This film is exposed, through a photographic mask, to UV radiation (step 2). The illuminated portions correspond to strips of metal that it is desired to protect. These portions of film are polymerized by the light energy (exposure phase), which endows them with better adhesion to the metal and resistance to the etching agents. The surface of the film is then subjected to the action of a stripping agent. The unpolymerized portions of film and the corresponding metal layer are removed from the surface of the substrate 54 (step 3).

In one embodiment of the invention, a second layer of metal is deposited above the first, after the stripping step, by means of an electrochemical or electroplating method.

In one embodiment of the invention, a second layer of metal is deposited above the first, after the stripping step, by means of an electrochemical or electroplating method.

Thus a plate of substrate 54, made of a polymer on which metal strips 51 are deposited, is obtained. The metal strips 51 may be arranged longitudinally aligned or aligned side by side. The substrate is made of a flexible or rigid material. The grid elements may or may not be cut.

These techniques furthermore make it possible to form marker elements on the substrate that will serve to position the "grid elements" with high accuracy during the stacking phase. These markers made of an absorbent material are formed at the same time as the metal strips.

In one embodiment of the invention, the substrate 54 is cut along the dotted lines, between the metal strips 51 so as to form strips 53 of substrate of width greater than the width of the metal strips 51. Thus discrete "grid elements" are obtained, each one comprising of a metal strip 51 absorbing radiation and of a strip of substrate 53 transparent to the radiation.

Figure 6:
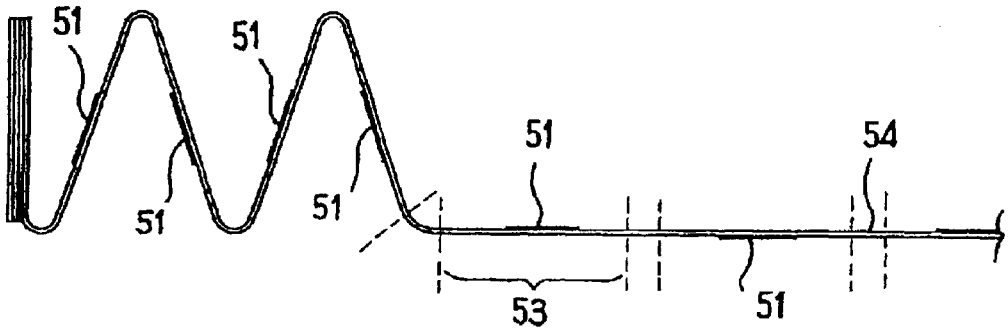
FIG. 6 is a diagram representing a variant of the method of FIG. 2 in which the elements are obtained by folding.
Figure 7:
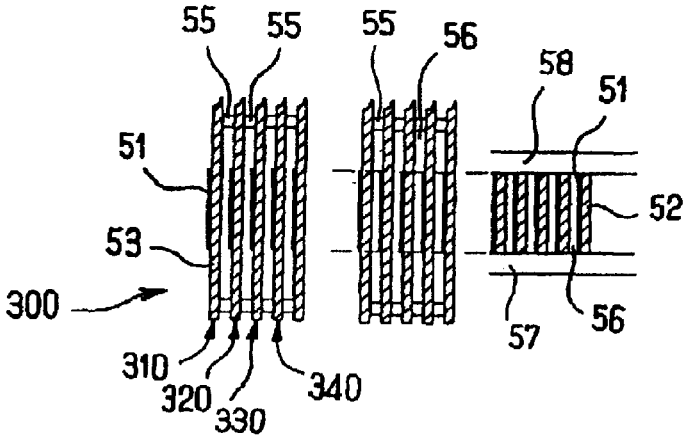
FIG. 7 is a diagram representing a second embodiment of the method of the invention in which the stacked elements are spaced apart from each other.

In another embodiment of the method of the invention, the substrate 54 comprises a flexible material. In order to fabricate flexible printed circuits, a polyimide is generally used as substrate, such as for example Kapton®. As shown in FIG. 6, metal strips 51 are etched onto the two faces of the substrate 54, the strips 51 being positioned alternately on one face of the substrate, then on the other. The substrate 54 is then folded "concertina-like" between the etched metal strips 51 so as to obtain a stack of continuous elements consisting of strips of absorbent material and strips made of material that is more transparent to the radiation. The excess portions of substrate are then cut.

In another embodiment of the invention, a substrate of reduced thickness (for example 100 $\mu$m) is used, on which metal strips 51 of about 5 to 40 $\mu$m thickness are deposited. These elements are stacked with a period of 200 to 400 $\mu$m. making it possible to keep spaces between the elements 310, 320, 330. The wedges 55 are positioned preferably pressing against the portions of substrate strip 53 which are not covered with metal, on each side of the metal strips 51 and as far as possible therefrom in order to obtain high accuracy of positioning. A film of adhesive 56 is then injected between the elements 310, 320, 330 thus held in place. When the adhesive 56 has cured, the excess substrate is cut along the dotted lines.

It is also possible to directly inject adhesive (cyanoacrylate or epoxide) between the elements 310, 320, 330 as the stack 300 is gradually formed. On curing, the adhesive directly forms positioning wedges. The advantage of the cyanoacrylate adhesive is that it cures quickly so that the wedges can be formed as the elements are being gradually positioned. To this end, it is enough to hold the element to be fixed in position while the adhesive sets.

It is also possible to inject expandable foam to fill the spaces between the elements. The foam has the advantage both of holding in position and assembling the "elements" with each other. If this foam is not adhesive enough, one solution consists in producing slots passing through the elements along their thickness and making it possible to produce a junction between the spaces. During its injection, the foam fills the spaces and the slots. On hardening, this foam forms a structure passing through the elements and thus guaranteeing their assembly.

The foam advantageously forms a rigid structure while producing very low attenuation of the radiation that pass through it.

This type of grid formed from a low-thickness substrate is particularly used in mammography. This is because the spaces made between the elements are wider than the thickness of the strips of substrate such that the transmission of the radiation is significantly improved.

In all cases, when the assembly has been produced and fixed, the excess portions of substrate, of foam or of adhesive are cut in order to form a grid of given thickness.

Cover plates 57 and 58 may possibly be positioned on each face in order to protect the stack 300. The presence of these protective plates is not crucial where the materials used to produce the stack are not hygroscopic.

In the embodiments of the method, because the portions of substrate have a width that is greater than the final thickness of the grid, they can be oriented with better accuracy than in the grids of the prior art. This results in better positioning of the absorbent plates in the final grid.

Furthermore, in the embodiments of the method, because the grid elements are positioned by pressing or grasping on those parts of the elements which are not covered with absorbent material, it is possible to use very narrow absorbent strips while maintaining a high accuracy of positioning and orientation. Thus, the embodiments of the method makes it possible to obtain grids having a thickness less than 1.5 mm, which is particularly advantageous for grids used in mammography, these grids having to filter as little direct radiation as possible.

One skilled in the art can or may make various modifications in structure and/or means and/or manner and/or way or equivalents thereof of the disclosed embodiments without departing from the scope and extent of the invention.

What is claimed is:

1. A method of fabricating an antiscatter grid comprising:

forming grid elements by covering portions of at least one substrate with strips made of a material absorbing radiation, the portions of the substrate are dimensioned with a width greater than the width of the strips made of the absorbent material;

superimposing the grid elements thus obtained on each other; and pressing or grasping the superimposed grid elements at least on the parts of the elements not covered with absorbent material.

2. The method according to claim 1 wherein the formation of the grid elements comprises:

depositing a layer of metal on a substrate by lamination;

covering the metal layer with a photosensitive film;

exposing the film through a photographic mask to radiation to polymerize the film in the illuminated portions corresponding to metal strips that it is desired to protect;

removing the unpolymerized portions of film; and removing the metal layer such that portions of metal remaining on the substrate form the strips.

3. The method according to claim 2 wherein the portions of metal remaining on the substrate also form markers for positioning the elements.

4. The method according to claim 2 comprising:

cutting the substrate into strips, each strip supporting a metal strip; and having a width greater than that of the metal strip.

5. The method according to claim 3 comprising:

cutting the substrate into strips, each strip supporting a metal strip; and having a width greater than that of the metal strip.

6. The method according to claim 2 wherein:

the metal strips are positioned parallel to each other;

the substrate is formed from a flexible material;

the substrate is folded between the metal strips;

each portion of the substrate contained between two successive folds forming a strip supporting a metal strip.

7. The method according to claim 3 wherein:

the metal strips are positioned parallel to each other;

the substrate is formed from a flexible material;

the substrate is folded between the metal strips;

each portion of the substrate contained between two successive folds forming a strip supporting a metal strip.

8. The method according to claim 1 wherein each element is positioned in contact with the preceding element.

9. The method according to claim 1 wherein each element is positioned at a distance from the preceding element.

10. The method according to claim 9 wherein the elements are kept at a distance from each other by inserting wedges bearing on the portions of substrate strip not covered with absorbent material.

11. The method according to claim 1 wherein each element is attached to a preceding element by injecting adhesive between the two elements.

12. The method according to claim 1 wherein each element is attached to a preceding element by injecting expandable foam between the two elements.

13. The method according to claim 1 wherein:

the elements are handled by a grasping or positioning device supporting an element to be positioned;

the grasping or positioning device supporting the element to be positioned is brought into position with respect to the preceding element by a swing arm system or a circular slideway guide system.

14. The method according to claim 1 wherein during handling, the substrate strips are kept on a vacuum mounting, the vacuum surface of which has a width greater than or equal to the width of the substrate strip.

15. The method according to claim 1 wherein during handling, the substrate strips are positioned by a system of guides or of rollers.

16. An antiscatter grid element comprising:

a strip made of a material absorbing radiation layered on a strip of substrate, thereby defining a laminate;

the strip of the substrate has a width greater than the width of the strip made of absorbent material.

17. The antiscatter grid element according to claim 16 wherein the substrate comprises plates made from a polymer.

18. The antiscatter grid element according to claim 16 wherein the substrate comprises plates formed from epoxy resin or from polyimide.

19. The antiscatter grid according to claim 16 wherein the absorbent strip is made of copper or of tantalum or of gold or of lead or of copper coated with gold or of copper coated with lead, alone or in combination thereof.

20. The antiscatter grid according to claim 18 wherein the absorbent strip is made of copper or of tantalum or of gold or of lead or of copper coated with gold or of copper coated with lead, alone or in combination thereof.

21. An antiscatter grid comprising:

a plurality of strips of a substrate;

a plurality of strips made of a material absorbing radiation layered on respective strips of the substrate, thereby defining a plurality of laminates;

the strip of the substrate having a width greater than the width of the strip made of radiation absorbent material.

22. The antiscatter grid according to claim 21 wherein the substrate comprises plates made from a polymer.

23. The antiscatter grid according to claim 21 wherein the substrate comprising plates formed from epoxy resin or from polyimide.

24. The antiscatter grid according to claim 21 wherein the absorbent strips are made of copper or of tantalum or of gold or of lead or of copper coated with gold or of copper coated with lead, alone or in combination thereof.

25. The antiscatter grid according to claim 21 wherein the grid has a thickness less than 1.5 mm.

* * * * *